US005339646A

United States Patent [19]

Verlinden et al.

[11] Patent Number: 5,339,646

[45] Date of Patent: Aug. 23, 1994

[54] APPARATUS FOR RECOVERY OF REFRIGERANT

[76] Inventors: Jerome M. Verlinden, 6980 W. Quarto Pl., Littleton, Colo. 80123; David R. Marini, 2253 Braun Ct., Golden, Colo. 80401

[21] Appl. No.: 967,205

[22] Filed: Oct. 19, 1992

[51] Int. Cl.[5] ..... F25B 45/00

[52] U.S. Cl. ..... 62/292; 62/475

[58] Field of Search ..... 62/77, 292, 475, 149; 141/4

[56] References Cited

U.S. PATENT DOCUMENTS

| | | | |
|---|---|---|---|
| 3,744,273 | 7/1973 | Ware | 62/498 |
| 4,367,637 | 1/1983 | Paulokat | 62/292 |
| 4,554,792 | 11/1985 | Margulefsky et al. | 62/77 |
| 4,766,733 | 8/1988 | Scuderi | 62/77 |
| 4,922,973 | 5/1990 | Keneavy | 141/4 |
| 5,022,230 | 6/1991 | Todack | 62/77 |
| 5,077,984 | 1/1992 | Vance | 62/292 |
| 5,101,637 | 4/1992 | Dailey | 62/50.2 |
| 5,123,259 | 6/1992 | Morgan, Sr. | 62/292 |

FOREIGN PATENT DOCUMENTS

| | | | |
|---|---|---|---|
| 2157573 | 6/1990 | Japan | 62/77 |

OTHER PUBLICATIONS

Copeland Refrigeration Manual, 1970 (pp. 27–17, 26–18).

*Primary Examiner*—John M. Sollecito
*Attorney, Agent, or Firm*—John E. Reilly

[57] ABSTRACT

A method and system for the recovery of refrigerant from a refrigeration system includes a consumable heat sink for rapidly reducing the temperature of a holding vessel to the saturation temperature of the refrigerant so that the refrigerant can be rapidly recovered without requiring a pump or compressor; and as the refrigerant is being recovered can be filtered to remove any contaminants. Provision is also made for expansion volume of the refrigerant during warm-up.

16 Claims, 1 Drawing Sheet

APPARATUS FOR RECOVERY OF REFRIGERANT

This invention relates to a method and apparatus for the recovery of refrigerant; and more particularly relates to a novel and improved system and method for the recovery of refrigerant from a refrigerant system, filtration of the refrigerant and reintroduction of the refrigerant back into the refrigeration system in such a way as to avoid release of ozone-depleting refrigerants into the atmosphere.

BACKGROUND AND FIELD OF THE INVENTION

Recent United States Federal, State and Local legislation regarding the "Montreal Protocol" prohibiting intentional release or venting of chlorofluorocarbons and hydrochlorofluorocarbons into the atmosphere has prompted the development of a process capable of recovering refrigerant from a refrigeration system, filtering contaminants, and returning the refrigerant to the refrigeration system after repairs are made.

Such recovery systems are typically comprised of a refrigerant piston-type compressor to create a reduced pressure in order to transfer the refrigerant from the refrigeration system to a storage vessel and representative patents are U.S. Pat. Nos. 3,744,273 to C. D. Ware, 4,367,637 to H. Paulokat, 4,554,792 to A. Margulefsky et al, 4,766,733 to C. J. Scuderi, 5,022,230 to J. J. Todack, 5,077,984 to J. H. Vance and 5,123,259 to E. C. Morgan, Sr. Other commercially available systems require some type of pump or compressor for refrigerant recovery thereby resulting in a high initial cost, high maintenance costs, poor portability and require electrical power to be available at the site of use. Moreover, recovery systems which employ compressors are susceptible to contaminants from the refrigerants they are recovering, cannot tolerate liquid refrigerant and suffer from compressor lubricant deprivation when their lubricant goes into solution with the recovered refrigerant resulting in a rapidly reduced "reclaim system" life and costly repairs.

It has been proposed to employ a refrigerant recovery system which eliminates the use of pumps or compressors. For example, U.S. Pat. No. 5,101,637 to B. E. Daily discloses a system comprised of a cryogenic container for either a liquid nitrogen or carbon dioxide composition which is capable of being vented to the atmosphere and which, when it volatilizes in a coil, will reduce the pressure in a separate storage cylinder surrounded by the coil. When the pressure is reduced in the container, it will remove the refrigerant from the refrigerant system as a result of pressure differential and, as the refrigerant condenses in the storage container, will continue to draw more refrigerant into that container. The use of a separate cryogenic container and associated plumbing is costly and reduces portability of the device; and, as a practical matter, in using carbon dioxide would require vaporization of that composition before it can be transferred in the form of sensible heat to the coil surrounding the storage vessel and therefore would increase the chill time. Furthermore, the use of an evaporator coil around the storage vessel will produce an air gap which tends to reduce the thermal transfer to the storage vessel and increase the chill time; nor does the system allow for overfilling of the storage container.

It is proposed in accordance with the present invention to provide a lightweight, portable recovery system which, among other features, employs a readily available, consumable heat sink for removal of the refrigerant from an abandoned or operating refrigerant unit with minimum chill time and in such a way as to avoid the use of electrical power, mechanical pumps or compressors as well as extensive plumbing.

SUMMARY OF THE INVENTION

It is therefore an object of the present invention to provide for a novel and improved method and means for recovering refrigerant from a refrigerant source which is highly efficient and dependable in use.

Another object of the present invention is to provide for a novel and improved method and apparatus for recovering refrigerant from a refrigerant source which achieves minimum chill time and avoids the use of electrical power while preventing the release of ozone-depleting refrigerants into the atmosphere.

An additional object of the present invention is to provide for a novel and improved lightweight, portable refrigerant recovery system which is of simplified construction, low in cost to operate and extremely versatile in use.

It is a still further object of the present invention to provide for a novel and improved method of recovering refrigerant either from an abandoned or operating refrigerant system which is capable of recovering the refrigerant from the system with a minimum chill time, filtering any contaminants therefrom and returning the refrigerant to the refrigerant system after servicing or repair of the system.

It is an additional object of the present invention to provide in a refrigerant recovery system for an easily replaceable, consumable heat sink in combination with an insulated storage vessel to effect refrigerant transfer from a closed refrigerant system and in such a way as to prevent release of ozone-depleting refrigerants into the atmosphere while achieving a minimum chill time; and further wherein means are provided for expansion and collection from the storage vessel of the refrigerant in response to thermal density changes.

In accordance with the present invention, a portable refrigerant recovery apparatus has been devised for recovering refrigerant from a refrigerant source without the aid of a pump compressor and comprises holding vessel means for receiving and retaining refrigerant in a sealed environment, refrigerant cooling means including a consumable heat sink for cooling said vessel means to a predetermined pressure and temperature level corresponding to the saturation temperature of the refrigerant to be recovered, conduit means for releasably connecting the vessel means to the refrigerant source whereby to withdraw the refrigerant from said source in response to the reduction of temperature and pressure in said vessel means, and an expansion vessel communicating with the vessel means. The method of refrigerant recovery in accordance with the present invention comprises the steps of placing a consumable heat sink in closely surrounding relation to the holding vessel whereby to reduce the temperature of the holding vessel to the saturation temperature of the refrigerant to be recovered, connecting the holding vessel to the refrigerant source and establishing open communication between the holding vessel and the refrigerant source until all of the refrigerant has been removed from the refrigerant source into the holding vessel, and disconnecting the refrigerant source from the holding vessel.

Both the method and apparatus of the present invention are characterized by employing a readily available consumable heat sink, such as, "dry ice" which can be place in direct contact with the vessel to reduce its temperature and create a low pressure region of 0 PSIG or below, and a replaceable filter cartridge is employed in the conduit means to remove any moisture, acids or impurities from the refrigerant when it is withdrawn from the refrigerant source.

The above and other objects, advantages and features of the present invention will become more readily understood and appreciated from a consideration of the following detailed description of a preferred embodiment of the present invention when taken together with the accompanying drawings in which:

DETAILED DESCRIPTION OF THE PREFERRED EMBODIMENT

Figure 1:
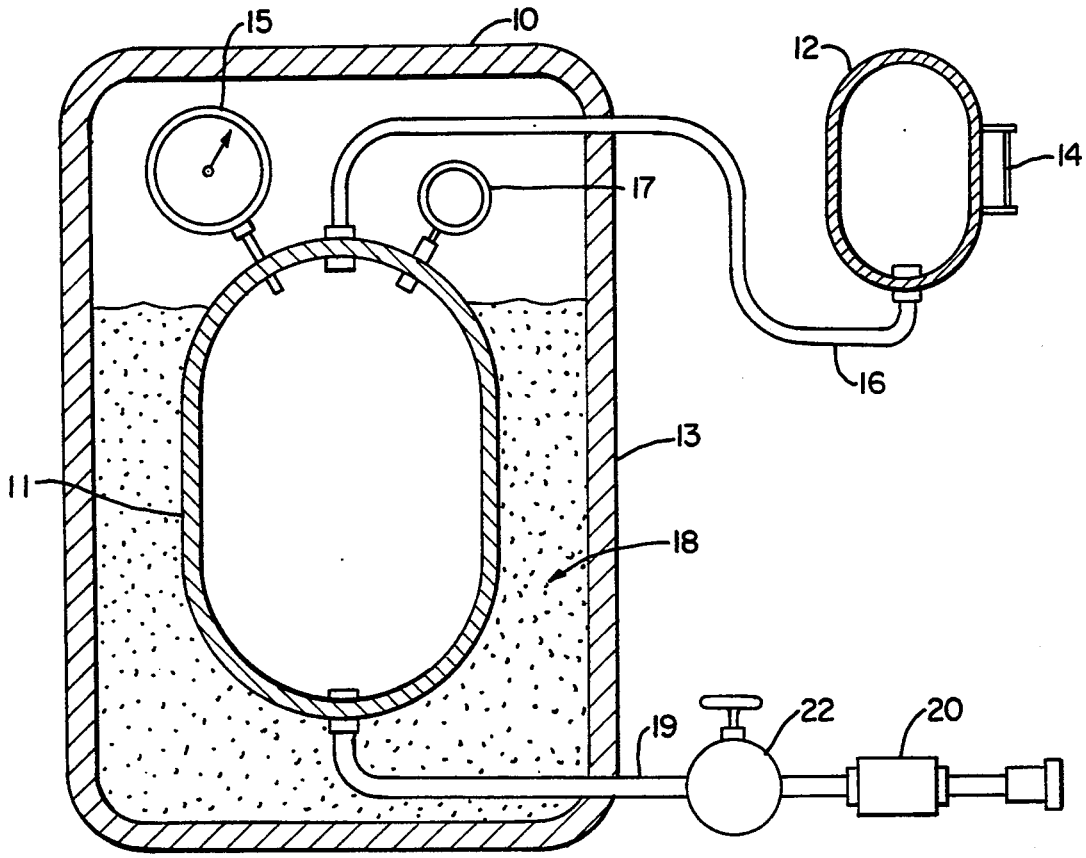
FIG. 1 is a schematic illustration of a preferred form of refrigerant recovery system in accordance with the present invention.

Referring in detail to the drawings, there is shown by way of illustrative example a preferred form of refrigerant recovery system 10 which is broadly comprised of a storage or holding vessel 11, expansion vessel 12, and an outer insulated storage case 13 which removably encloses the storage vessel 11. A sight glass 14 is positioned on the expansion vessel 12, and a conduit 16 extends from the storage vessel 11 to the expansion vessel 12 in the event of an overfill condition in the storage vessel 11. In addition, a pressure gauge 15 and pressure relief valve 17 are mounted on the storage vessel 11, and a conduit 19 having an on/off valve 22 extends from the lower end of the storage vessel 11 for connection to a refrigerant source. A replaceable filter cartridge 20 is disposed in the conduit 19 for the purpose of filtering contaminants from the refrigerant as a preliminary to delivery into the storage vessel.

An important feature of the present invention resides in the use of a consumable or expendable heat sink 18 positioned in the storage case 13 in direct contact with the outer wall of the vessel 11. Preferably, the heat sink is composed of a solid carbon dioxide substance, commonly referred to as "dry ice", which is capable of creating a low pressure region of 0 PSIG or below according to the following Table representing the refrigerant pressure/temperature relationship. Saturation temperature of different refrigerants at 0 PSIG (5280' above sea level) is as follows: R-12 dichlorodifluoromethane ($CCl_2F_2$) −28° F. R-22 monochlorodifluoromethane ($CHClF_2$) −48° F. R-500 an azeotropic mixture ($CCl_2F_2/CH_3CHF_2$) −36° F. R-502 an azeotropic mixture ($CHClF_2/CClF_2CF_3$) −56° F. The foregoing are given for the purpose of illustration and not limitation, and it is to be understood that other packaged endothermic chemical reaction compounds may be employed in place of "dry ice" to create the desired low pressure region. Nevertheless, "dry ice" is preferred, owing to its ready availability and ease of handling. Thus, for a storage vessel 11 having a capacity of 5 lbs., a 1" space surrounding the vessel is filled with "dry ice" and is capable of reducing the temperature of the refrigerant to the specified levels over a minimal time period. The chill time of the vessel 11 will vary with the size of the vessel 11 and the time of recovery will vary according to the volume of refrigerant to be recovered. "Chill time" is that time required to reduce the holding vessel temperature sufficiently to create a pressure differential for liquid flow or, in other words, to reduce the temperature of the holding vessel to a level that will establish a saturation pressure of 0 PSIG for the refrigerant being reclaimed. For instance, the approximate time to chill the vessel to recover 5 lbs. of CFC-12 is on the order of 5 minutes and the recovery rate is on the order of 5 lbs. per minute, the recovery rate being the flow rate of refrigerant into the storage or holding vessel after the vessel has been allowed to chill to its saturation pressure of 0 PSIG.

In an illustrative recovery operation, "dry ice" is fragmented and packed into the insulated case 13 so as to surround the storage vessel 11, and the system is transported to the job site. The conduit or hose 19 is attached to the system or unit from which the refrigerant is to be removed. A valve on the refrigeration system as well as valve 22 are opened to remove all liquid and vapor refrigerant through the hose 19, and the replaceable filter cartridge 20 will remove any moisture, acids or particulate impurities from the refrigerant.

In order to return the refrigerant from the holding vessel 11 to the refrigeration system, the refrigerant within the vessel 11 must be warmed to ambient temperature either statically, such as, by removal from the outer case 13, or by inducing heat to the vessel 11 to increase pressure. Refrigerant can be withdrawn from the vessel 11 to the system by using the refrigeration system's compressor to create a pressure differential. The density of the refrigerant will increase with increases in temperature within the vessel 11; and to accommodate the volume increase of the refrigerant liquid, an expansion vessel 12 is connected via conduit 16 to the holding vessel 11. The expansion vessel 12 remains at ambient temperature outside of the case 13 and normally at a greater pressure than that of the storage vessel 11. However, with increases in pressure in the storage vessel 11, liquid refrigerant will pass into the expansion vessel 12 so as to avoid a rupture condition within the storage vessel 11. The sight glass 14 will provide a visual verification of the refrigerant level within the expansion vessel 12 in order to assure that no liquid refrigerant is present during transfer of the refrigerant from the refrigeration system.

Figure 2:
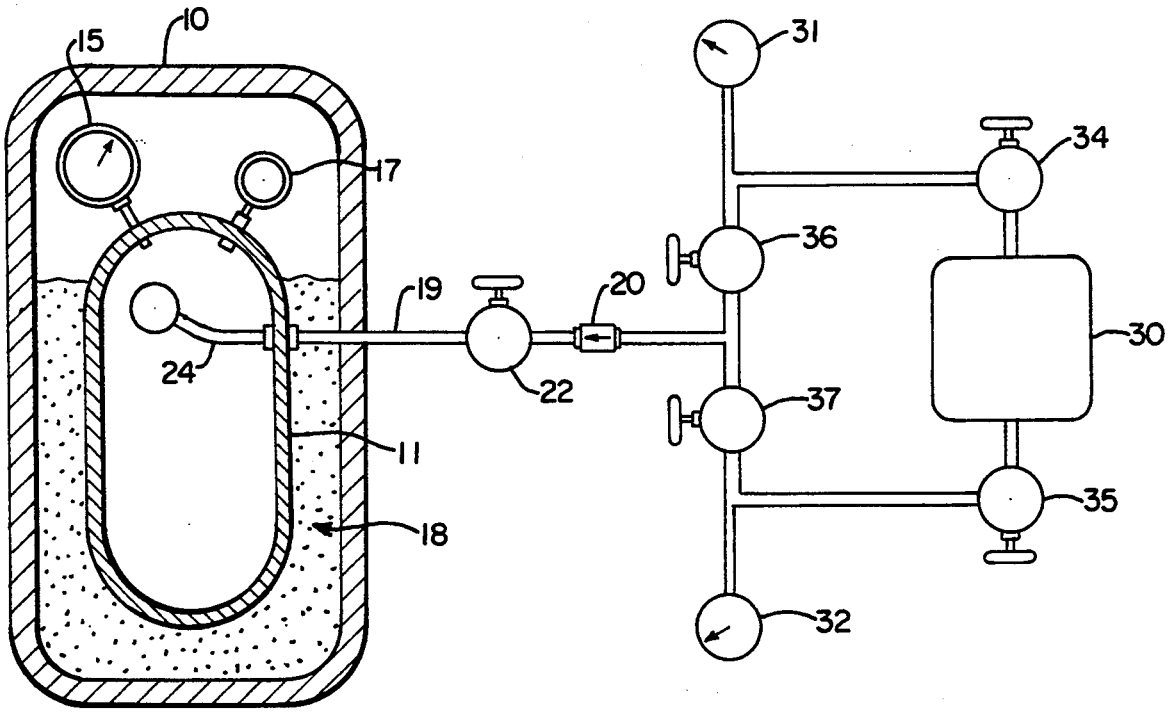
FIG. 2 is a schematic illustration of a modified form of refrigerant recovery system in connected relation to a conventional refrigeration unit for the recovery of refrigerant therefrom.

Reference is made to FIG. 2 which discloses a modified form of recovery system attached to a conventional refrigeration unit 30 for the recovery of refrigerant. As an alternate method of providing expansion volume, a liquid level float control 24 is disposed in the storage vessel 11 to restrict filling of the storage vessel to approximately 80% of its total volume during transfer thereby allowing for expansion volume during warm-up. As shown, the conduit 19 is connected via a gauge manifold having gauges 31 and 32 to the refrigeration unit 30 and filter dryer 20 has its flow arrow in the position indicated. Service valves 34 and 35 which represent high pressure and low pressure valves, respectively, are opened along with manifold valves 36 and 37. The shut-off valve 22 in the line 19 is then opened to permit flow of refrigerant from the unit 30 into the holding vessel 11.

After the refrigerant has filled the storage vessel 11, the hand valves 36 and 37 are closed followed by turning off the shut-off valve 22 following which the vessel 11 is removed from the dry ice and permitted to increase to ambient temperature while repairs are being made to the refrigeration unit 30. If repairs are completed before the vessel 11 has reached ambient temperature, the vessel 11 can be placed in a container of hot water to increase its pressure.

In order to recharge the system 30, the system 30 is evacuated and checked for any leaks. The filter cartridge 19 has its flow reversed so that the flow is from the vessel 11 toward the unit 30. With the hoses and particularly the hose 19 connected for charging, the valves on the recovery device are opened and any air purged from the line at the gauge manifold 32; and thereafter the compressor 40 is activated in order to draw the refrigerant from the vessel 11 back into the unit 30.

From the foregoing, it will be evident that modifications may be made in the utilization of the system of the present invention and its method of recovery. For example, an alternate method of providing expansion volume is to add the liquid level float control 24 as described and in place of the expansion vessel 12. The storage vessel 11 is preferably composed of a metal having high heat transfer characteristics, such as, brass, copper, steel or aluminum and can range in size from 5 lbs. to 50 lbs. storage capacity and still maintain its portability. The volume or capacity of the expansion vessel is preferably 20% of the volume of the storage vessel 11.

It is therefore to be understood that while preferred and modified forms of recovery systems are herein set forth and described, the above and other modifications and changes may be made in the method and apparatus of the present invention without departing from the spirit and scope of the invention as defined by the appended claims and reasonable equivalents thereof.

We claim:

1. A portable refrigerant recovery apparatus for recovering refrigerant from a refrigerant source without the use of a motive power source, such as, a pump or compressor comprising:

holding vessel means for receiving and retaining refrigerant in a sealed environment;

refrigerant cooling means including a consumable heat sink for cooling said vessel means to a predetermined temperature and pressure level corresponding to the saturation temperature of the refrigerant to be recovered;

conduit means for releasably connecting said vessel means to said refrigerant source whereby to withdraw the refrigerant from said source in response to the reduction of temperature in said vessel means; and expansion volume control means communicating with said holding vessel means to prevent overfilling of said holding vessel means.

2. The apparatus according to claim 1, said cooling means being composed of a consumable heat sink in closely surrounding relation to said holding vessel means.

3. The apparatus according to claim 1, said cooling means comprising dry ice disposed in direct contact with said holding vessel means.

4. The apparatus according to claim 1, said control means defined by an expansion vessel exposed to ambient temperatures.

5. The apparatus according to claim 4, said expansion vessel disposed at a higher pressure level than said holding vessel means.

6. The apparatus according to claim 1, said expansion vessel having a sight glass for indicating liquid level in said expansion vessel.

7. The apparatus according to claim 1, including a pressure gauge connected to said holding vessel means, and said conduit means including a filter/dryer member therein.

8. The apparatus according to claim 7, said filter/dryer member defined by a replaceable filter cartridge.

9. The apparatus according to claim 8, including an on-off valve in said conduit means.

10. The apparatus according to claim 1, including an insulated housing in outer surrounding relation to said holding vessel means and said cooling means, said cooling means being removably disposed in said housing.

11. The apparatus according to claim 1, said control means being in the form of a liquid level control valve associated with said holding vessel means to limit filling of said holding vessel means to a predetermined level.

12. The apparatus according to claim 11, said control valve including a float control arm in said holding vessel means to limit filling of said vessel to 80% of its total volume.

13. A portable refrigerant recovery apparatus for recovering refrigerant from a refrigerant source comprising:

holding vessel means for receiving said retaining refrigerant in a sealed environment;

refrigerant cooling means including a consumable heat sink for cooling said vessel means to a predetermined temperature and pressure level corresponding to the saturation temperature of the refrigerant to be recovered, said cooling means comprising dry ice disposed in closely surrounding relation to said holding vessel means; and conduit means for releasably connecting said vessel means to said refrigerant source whereby to withdraw the refrigerant from said source in response to the reduction of temperature in said vessel means, said conduit means including a replaceable filter cartridge therein, said float valve means in said conduit means for interrupting the flow of refrigerant from said source into said holding vessel means in response to filling said holding vessel means to a predetermined level.

14. The apparatus according to claim 13, including an expansion vessel communicating with said holding vessel means, said expansion vessel exposed to ambient temperatures.

15. The apparatus according to claim 14, said expansion vessel disposed at a higher pressure level than said holding vessel means, and a sight glass for indicating liquid level in said expansion vessel.

16. The apparatus according to claim 13, including an insulated housing in outer surrounding relation to said holding vessel means and said cooling means, said cooling means and said holding vessel means being removably disposed in said housing.

* * * * *